US009031459B2

(12) United States Patent
Ikeda et al.

(10) Patent No.: US 9,031,459 B2
(45) Date of Patent: May 12, 2015

(54) PROCESS CARTRIDGE AND IMAGE FORMING DEVICE

(71) Applicant: MITSUBISHI CHEMICAL CORPORATION, Chiyoda-ku (JP)

(72) Inventors: Shuichi Ikeda, Odawara (JP); Akira Ando, Odawara (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 14/035,460

(22) Filed: Sep. 24, 2013

(65) Prior Publication Data

US 2014/0023395 A1 Jan. 23, 2014

Related U.S. Application Data

(63) Continuation of application No. PCT/JP2012/056326, filed on Mar. 12, 2012.

(30) Foreign Application Priority Data

Mar. 24, 2011 (JP) ..... 2011-066705
Mar. 24, 2011 (JP) ..... 2011-066706

(51) Int. Cl.
*G03G 15/00* (2006.01)
*G03G 21/18* (2006.01)
*G03G 21/16* (2006.01)

(52) U.S. Cl.
CPC ..... *G03G 21/1839* (2013.01); *G03G 15/757* (2013.01); *G03G 21/1647* (2013.01); *G03G 21/1671* (2013.01); *G03G 15/751* (2013.01); *G03G 21/1857* (2013.01)

(58) Field of Classification Search
CPC ..... G03G 21/1857; G03G 15/757
USPC ..... 399/117, 116, 111
See application file for complete search history.

(56) References Cited

U.S. PATENT DOCUMENTS 7,980,775 B2 7/2011 Shimizu et al.
2007/0110474 A1* 5/2007 Ueno et al. ..... 399/117

(Continued)

FOREIGN PATENT DOCUMENTS

JP 2001-215765 8/2001
JP 2003-066769 3/2003

(Continued)

OTHER PUBLICATIONS

International Search Report issued Apr. 3, 2012 in PCT/JP2012/056326 filed Mar. 12, 2012.

(Continued)

*Primary Examiner* — Rodney Bonnette
(74) *Attorney, Agent, or Firm* — Oblon, McClelland, Maier & Neustadt, L.L.P.

(57) ABSTRACT

An image forming device, including a cylindrical photoreceptor drum, an end member having a tubular body which is mounted at an end portion of the photoreceptor drum and which has an outer circumferential surface serving as a sliding surface, and a bearing configured to have a hole which defines an inner peripheral surface that corresponds to a sliding surface, the bearing supporting the tubular body of the end member by inserting the tubular body into the hole, wherein a difference between an outside diameter of a part provided with the sliding surface of the end member and a diameter of the hole of the bearing is equal to or more than 0.06 mm and equal to or less than 0.5 mm.

13 Claims, 6 Drawing Sheets

(56) References Cited

U.S. PATENT DOCUMENTS

| | | | | |
|---|---|---|---|---|
| 2011/0268471 | A1* | 11/2011 | Miyazaki et al. | 399/111 |
| 2014/0044457 | A1 | 2/2014 | Ikeda | |

FOREIGN PATENT DOCUMENTS

| | | |
|---|---|---|
| JP | 2004-126616 | 4/2004 |
| JP | 2006-113403 | 4/2006 |
| JP | 2006-293021 | 10/2006 |
| JP | 2008-170741 | 7/2008 |
| JP | 4415532 | 12/2009 |

OTHER PUBLICATIONS

Extended European Search Report issued Aug. 20, 2014 in Patent Application No. 12760083.1.

* cited by examiner

PROCESS CARTRIDGE AND IMAGE FORMING DEVICE

CROSS REFERENCE TO RELATED APPLICATIONS

This application is a continuation of PCT application No. PCT/JP2012/056326, which was filed on Mar. 12, 2012 based on Japanese Patent Application (No. 2011-066706) filed on Mar. 24, 2011 and Japanese Patent Application (No. 2011-066705) filed on Mar. 24, 2011, the contents of which are incorporated herein by reference.

BACKGROUND OF THE INVENTION

1. Field of the Invention

The present invention relates to an image forming device such as a laser printer or a copying-machine, and more particularly, to a process cartridge and an image forming device having a photoreceptor drum unit.

2. Description of the Related Art

An image forming device such as a laser printer or a copying-machine has an image forming device body and a process cartridge detachably attached to the body.

The process cartridge is a member which transfers, to recording media such as paper, contents such as characters and graphics to be indicated. This member is equipped with a photoreceptor drum unit on which the content to be transferred is formed. Accordingly, in the process cartridge, various means for forming, on the photoreceptor drum unit, contents to be transferred are also arranged. For example, means respectively performing development, charging, and cleaning can be cited as the various means.

The photoreceptor drum provided in the photoreceptor drum unit is a cylindrical member. While operated, the drum is rotated around the axis of a cylinder. In order to rotate the photoreceptor drum in this way, a gear provided at the side of the image forming device body transmits a driving force through a driving shaft to another gear provided at a member (end member) mounted at an end portion of the photoreceptor drum.

In such a system, particularly, a color machine provided with plural photoreceptor drums has a fear of color shift, color unevenness or the like caused by a deficiency of rotation accuracy. Thus, it is necessary to provide a high-precision gear at the end member.

The cases of applying, in order to deal with this problem, the following two types of driving methods have increased. According to these driving methods, the above problem can be solved without requiring high-precision gears. Not only a color machine but a black-and-white machine has similar advantages.

A first driving method is to put a penetration shaft through the photoreceptor drum and transmit a driving force to the photoreceptor drum using a key-groove or the like. According to this driving method, the high-precision gears for receiving a driving force from the image forming device body are made unnecessary. However, because the penetration shaft is necessary, there are problems that it is difficult to assemble the photoreceptor drum unit, and that the exchange of a photoreceptor drum takes time.

A second driving method is to transmit, without using a penetration shaft, a driving force directly to a coupling provided at an end member mounted at the photoreceptor drum. Several types of this driving method can be cited. Among them, one type of this driving method uses a sliding surface made of a resin as a shaft while a driving force is received at the coupling provided at the end member, or another type thereof supplementarily uses a sliding surface made of a resin as a shaft. According to such a type of using the sliding surface made of a resin as the shaft (including the type of supplementarily using the sliding surface made of a resin as the shaft), accuracy of transmitting a rotating force is high. The assembly of the photoreceptor drum unit and the exchange of the photoreceptor drum are easily achieved.

For example, Japanese Patent No. 4,415,532 discloses a technique of using the sliding surface made of a resin while a driving force is received at the coupling.

SUMMARY OF THE INVENTION

According to the type using the sliding surface made of a resin as disclosed in Japanese Patent No. 4,415,532, a bearing may be provided to face and support the sliding surface of the end member. The bearing has an annular part arranged to cover the sliding surface of the end member.

Heretofore, at the rotation of the photoreceptor drum unit, friction heat has been caused between the bearing and the sliding surface (side surface) of the end member, resulting in occurrence of melting of the end member and the bearing or adhesion between them.

In order to solve such a problem, the supply of a lubricant-agent such as grease to the sliding surface has been performed.

However, in the case of using a lubricant-agent, there has been a risk of occurrence of troubles that the photoreceptor drum unit is out of lubricant-agent and that the lubricant-agent leaks out and stains the photoreceptor drum. Consequently, development failure may occur. Appropriate printing may not been performed. Eventually, the function of serving as a photoreceptor drum may be hindered. In addition, even from the viewpoint of preparation, the step of coating with lubricant-agent is required. Thus, there have been the problem of reduction in productivity and that of increase in cost. That is, in order to solve such quality problems, an embodiment that does not require a lubricant-agent is demanded.

In addition, particularly, with recent years' increase of printing speed, the rotational speed of the photoreceptor drum has risen. Thus, the sliding speed between the end member and the bearing tends to rise. Consequently, an embodiment that does not require a lubricant-agent is more demanded.

Accordingly, an object of the present invention is to provide a process cartridge and an image forming device which do not require a lubricant-agent between an end member and a bearing.

The above object of the present invention is achieved by the following configurations.

(1) An image forming device, including:

a cylindrical photoreceptor drum;

a member having a tubular body which is mounted at an end portion of the photoreceptor drum and which has an outer circumferential surface serving as a sliding surface; and a bearing configured to have a hole which defines an inner peripheral surface that faces the sliding surface, the bearing supporting the tubular body of the member by inserting the tubular body into the hole, wherein a difference between an outside diameter of a part provided with the sliding surface of the member and a diameter of the hole of the bearing is equal to or more than 0.06 mm and equal to or less than 0.5 mm.

(2) The image forming device according to the configuration (1), wherein the sliding surface of the member has an arithmetic average roughness (Ra) in one direction being equal to or more than 0.5 μm.

(3) The image forming device according to the configuration (2), wherein a kurtosis (Ku) of the sliding surface of the member is equal to or less than 2.8.

The image forming device according to any one of the configurations (1) to (3), wherein at least one of the sliding surface of the member and the inner peripheral surface of the bearing has an axial inclination.

A process cartridge, including:

a cylindrical photoreceptor drum;

a member having a tubular body which is mounted at an end portion of the photoreceptor drum and which has an outer circumferential surface serving as a sliding surface; and a bearing configured to have a hole which defines an inner peripheral surface that faces the sliding surface, the bearing supporting the tubular body of the member by inserting the tubular body into the hole, wherein a difference between an outside diameter of a part provided with the sliding surface of the member and a diameter of the hole of the bearing is equal to or more than 0.06 mm and equal to or less than 0.5 mm.

(6) The process cartridge according to the configuration (5), wherein the sliding surface of the member has an arithmetic average roughness (Ra) in one direction being equal to or more than 0.5 μm.

(7) The process cartridge according to the configuration (6), wherein a kurtosis (Ku) of the sliding surface of the member is equal to or less than 2.8.

(8) The process cartridge according to any one of the configurations (5) to (7), wherein at least one of the sliding surface of the member and the inner peripheral surface of the bearing has an axial inclination.

(9) A member having a tubular body which is mounted at an end portion of a photoreceptor drum, and which has an outer peripheral surface serving as a sliding surface, wherein the sliding surface has an arithmetic average roughness (Ra) in one direction being equal to or more than 0.5 μm.

(10) The member according to the configuration (9), wherein a kurtosis (Ku) of the sliding surface is equal to or less than 2.8.

(11) The member according to the configuration (9) or (10), wherein the sliding surface has an axial inclination.

(12) A photoreceptor drum unit, including:

a cylindrical photoreceptor drum; and a member having a tubular body which is mounted at an end portion of the photoreceptor drum and which has an outer circumferential surface serving as a sliding surface, wherein the sliding surface of the member has an arithmetic average roughness (Ra) in one direction being equal to or more than 0.5 μm.

(13) The photoreceptor drum unit according to the configuration (12), wherein a kurtosis (Ku) of the sliding surface of the member is equal to or less than 2.8.

(14) The photoreceptor drum unit according to the configuration (12) or (13), wherein the sliding surface of the member has an axial inclination.

(15) A process cartridge, including:

a cylindrical photoreceptor drum;

a member having a tubular body which is mounted at an end portion of the photoreceptor drum and which has an outer circumferential surface serving as a sliding surface; and a charging roller which is a cylindrical roller provided to be able to electrically charge the photoreceptor drum, and a developing roller which is a cylindrical roller that supplies a developer to the photoreceptor drum, wherein the sliding surface of the member has an arithmetic average roughness (Ra) in one direction being equal to or more than 0.5

(16) The process cartridge according to the configuration (15), wherein a kurtosis (Ku) of the sliding surface of the member is equal to or less than 2.8.

(17) The process cartridge according to the configuration (15) or (16), wherein the sliding surface of the member has an axial inclination.

(18) An image forming device, including:

a cylindrical photoreceptor drum;

a member having a tubular body which is mounted at an end portion of the photoreceptor drum and which has an outer circumferential surface serving as a sliding surface;

a rotating shaft connected to the end portion and configured to rotate the member and the photoreceptor drum; and a bearing configured to have a hole which defines an inner peripheral surface that faces the sliding surface, the bearing supporting the tubular body of the member by inserting the tubular body into the hole, wherein the sliding surface of the member has an arithmetic average roughness (Ra) in one direction being equal to or more than 0.5 μm.

(19) The image forming device according to the configuration (18), wherein a kurtosis (Ku) of the sliding surface of the member is equal to or less than 2.8.

(20) The image forming device according to the configuration (18) or (19), wherein at least one of the sliding surface of the member and the inner peripheral surface of the bearing has an axial inclination.

According to the present invention, a lubricant-agent such as grease, which has heretofore been used, is not used.

According to the present invention, the difference between the outside diameter of a part provided with the sliding surface of the member mounted at the end portion of the photoreceptor drum and the inside diameter of the bearing is equal to or more than 0.06 mm and equal to or less than 0.5 mm. Heretofore, there has been no combination of the member and the bearing which have such a diameter difference.

The higher the sliding speed on the sliding surface, the more effective the present invention is. Preferably, the sliding speed ranges from 3.2 m/minute to 18.9 m/minute. More preferably, the sliding speed is equal to or higher than 10 m/minute.

According to the present invention, the kurtosis Ku is preferably equal to or less than 2.8, and more preferably is equal to or less than 2.6.

Arithmetic average roughness Ra and a kurtosis Ku appearing in the description of the present invention are regulated in Japanese Industrial Standards (JIS) B 0601-1994 and JIS B 0601-2001.

According to the present invention, the material of the bearing is not limited to a specific one. Preferably, the material of the bearing is polystyrene, polycarbonate, or polyacetal. More preferably, the material of the bearing is polyacetal.

DETAILED DESCRIPTION OF THE EMBODIMENTS

The above operations and advantages of the present invention are demonstrated by the following modes for carrying out the present invention. Hereinafter, the present invention is described with reference to embodiments illustrated in the attached drawings. However, the present invention is not limited to these embodiments.

First Embodiment

A first embodiment has a feature of the amount of gap between the sliding surfaces of a cylindrical body of a member (end member) mounted at an end portion of a photoreceptor drum and a bearing that supports the cylindrical body.

Figure 1:
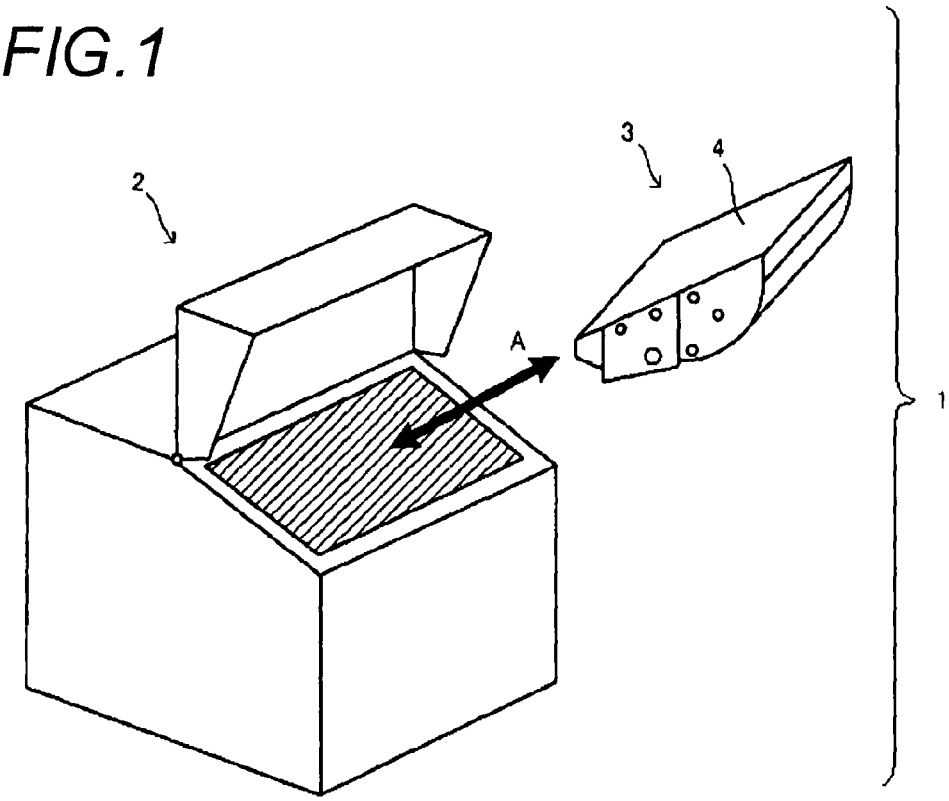
FIG. 1 is an explanatory diagram illustrating a configuration of an image forming device.

FIG. 1 is an explanatory view illustrating one embodiment of the present invention and also serves as a perspective view schematically illustrating an image forming device 1. A laser printer, a copying machine, a facsimile, or the like is exemplified as an image forming device. As can be seen from FIG. 1, the image forming device 1 includes an image forming device body 2, and a process cartridge 3.

The image forming device body 2 is a part configuring a major portion of the image forming device 1. As described below, the image forming device body 2 has a rotating shaft 21. In addition, the image forming device body 2 includes each necessary component part other than the process cartridge 3.

Figure 2:
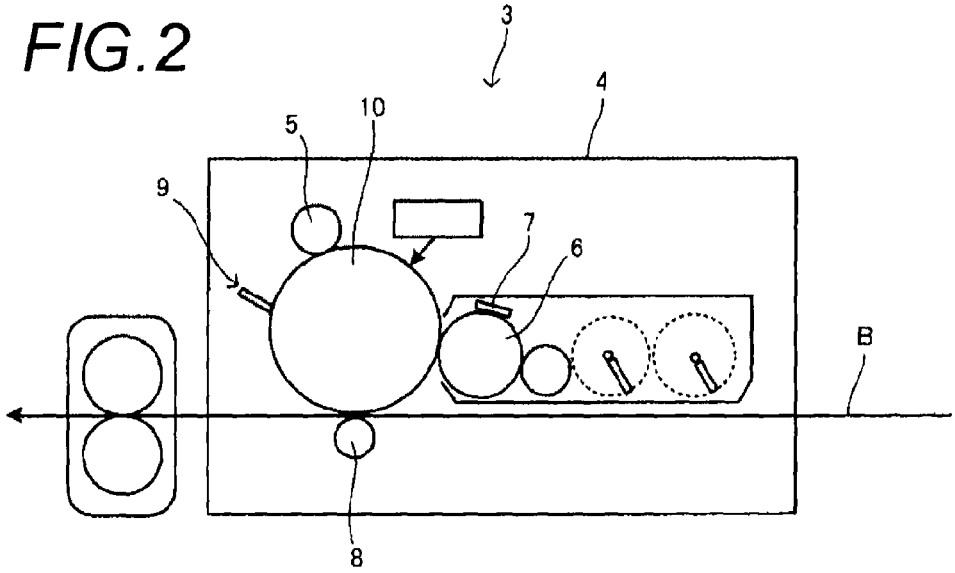
FIG. 2 is a diagram illustrating a configuration of a process cartridge.

The process cartridge 3 is a member in which an image to be transferred to a medium such as paper is formed. As indicated by arrow A in FIG. 1, the process cartridge 3 is attachable and detachable to and from the image forming device body 2. FIG. 2 conceptually illustrates the configuration of the process cartridge 3.

The process cartridge 3 has a casing 4 configuring an outer shell thereof. Various components are contained inside the casing 4. More specifically, this embodiment includes a photoreceptor drum unit 10 (see FIG. 3), a charging roller 5, a developing roller 6, a regulating member 7, a transfer unit 8, and a cleaning blade 9. A medium such as paper moves along a line designated by B in FIG. 2 in the process cartridge 3 thereby to form an image on the medium.

Figure 3:
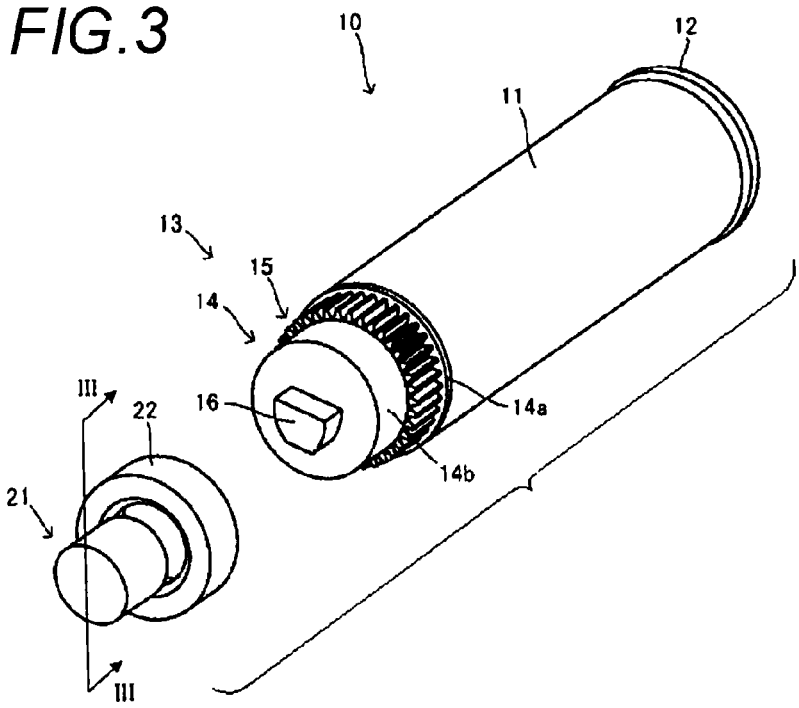
FIG. 3 is an exploded perspective view illustrating a photoreceptor drum unit, a rotating member, and a bearing.
Figure 4A:
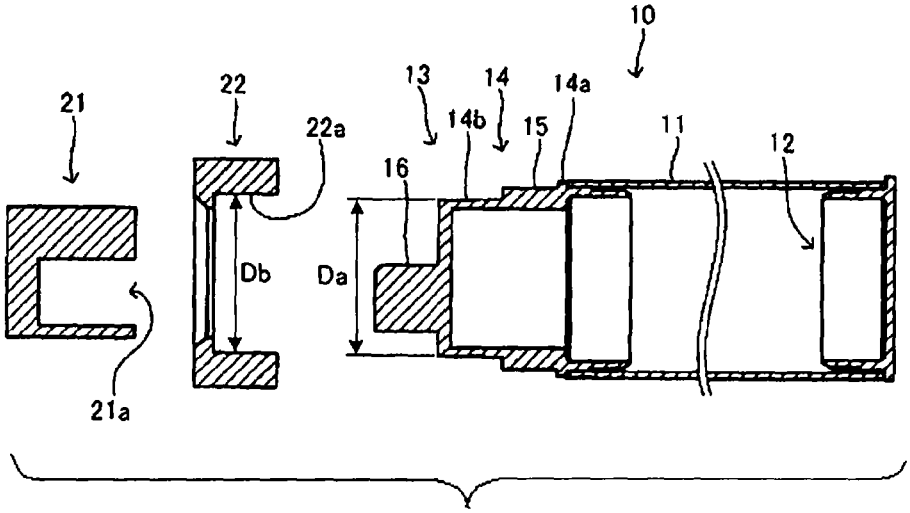
FIG. 4A is a cross-sectional view taken along line III-III shown in FIG. 3.
Figure 4B:
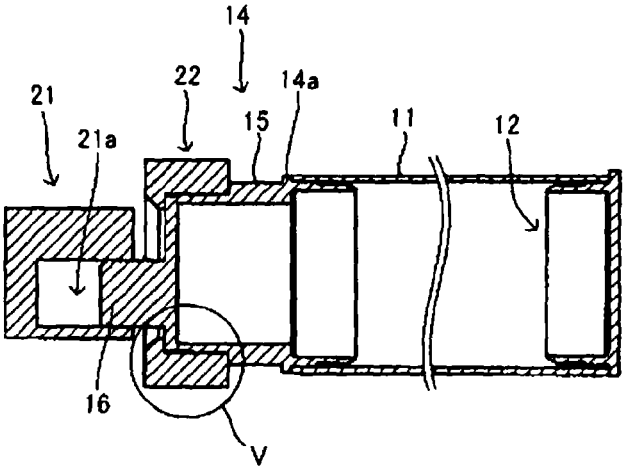
FIG. 4B is a diagram illustrating the photoreceptor drum unit, the rotating member, and the bearing illustrated in FIG. 4A, which are combined with one another.

On the photoreceptor drum unit 10, characters, graphics, and the like to be transferred onto a recording medium such as paper are formed. FIG. 3 shows an exploded perspective view of the rotating shaft 21 provided in the image forming device body 2, a bearing 22 provided in the image forming device body 2 or in the process cartridge 3, and the photoreceptor drum unit 10 provided in the process cartridge 3. FIG. 4A shows a cross-sectional view taken along line III-III illustrated in FIG. 3. FIG. 4B shows a diagram illustrating, on the cross-section, a state in which the rotating shaft 21, the bearing 22 and the photoreceptor drum unit 10 are combined with one another.

As can be seen from FIGS. 3, 4A, and 4B, the photoreceptor drum unit 10 includes a photoreceptor drum 11, a flange 12, and an end member 13.

The photoreceptor drum 11 is a member formed by coating an outer peripheral surface of a cylindrical drum cylinder with a photosensitive layer.

The drum cylinder is configured by applying the photosensitive layer onto a cylindrical electrically-conductive cylinder made of aluminum or the like. The photosensitive layer formed thereon is not limited to a specific one. Known photosensitive layer can be applied thereto.

As will be described below, the end member 13 is arranged at one end of the photoreceptor drum 11, while the other end thereof is provided with the flange 12.

The flange 12 is a member formed of a resin. In the flange 12, a fitting portion to be fit into the cylinder of the photoreceptor drum 11, and a bearing-portion arranged to cover one end surface of the photoreceptor drum 11 are formed concentrically. The bearing-portion is shaped like a disc so as to cover one end surface of the photoreceptor drum 11. The bearing-portion is provided with a part that bears a shaft (not shown) provided in the image forming device body 2. In addition, an earth plate made of an electrically-conductive material is arranged on the flange 12 to thereby electrically connect the photoreceptor drum 11 and the image forming device body 2 with each other.

The end member 13 is attached to the photoreceptor drum 11. The end member 13 is an example of a member which has a sliding surface that does not require a lubricant-agent. The end member 13 is attached to one of end portions of the photoreceptor drum 11, which is opposite to the above flange 12. The end member 13 has the functions of receiving a rotating force from the rotating shaft 21 of the image forming device body 2, rotating the photoreceptor drum unit 10 itself, and transmitting the rotating force to other rollers (e.g., a charging-roller). More specifically, the end member 13 includes a tubular body 14, a gear portion 15 provided on an outer peripheral surface of the tubular body 14, and a connection portion 16.

The tubular body 14 is a cylindrical bottomed member which has a bottom at one of end portions thereof and which is provided with a ring-like contact wall 14*a* erected on an outer peripheral surface thereof. The outside diameter of a part extending to the non-bottom side of the tubular body 14 from the contact wall 14*a* is substantially equal to the inside diameter of the photoreceptor drum 11. As can be seen from FIGS. 4A and 4B, the tubular body 14 can be fit into the photoreceptor drum 11 by inserting one-end side of the tubular body 14 into the drum 11. Consequently, the end member 13 can be fixed to the photoreceptor drum 11. At that time, the one-end side of the tubular body 14 is inserted to a depth at which one end surface of the photoreceptor drum 11 abuts against the contact wall 14*a*. At that time, an adhesive agent may be used for more secure attachment.

However, a sliding surface 14*b* is formed on a part of the outer peripheral surface of the tubular body 14, which part protrudes from the photoreceptor drum 11, without being inserted into the photoreceptor drum 11, at the bottomed side of the body 14. The sliding surface 14*b* is a part arranged to face the inner peripheral surface of the bearing 22, as will be described below.

The outside diameter Da of the part (hereinafter sometimes referred to simply as the sliding surface 14*b*) provided with the sliding surface 14*b* of the tubular body 14 is set to be smaller than the inside diameter Db (hereinafter sometimes referred to simply as the inside diameter of the bearing), by 0.06 mm or more, of the part (hole) of the bearing 22, into which the sliding surface 14*b* is inserted. If at least one of the sliding surface 14*b* and the inner peripheral surface 22*a* of the bearing 22 has an axial inclination (what is called a taper), the difference between the outside diameter Da of the part provided with the sliding surface 14*b* and the inside diameter Db of the bearing 22 is 0.06 mm or more at each part in which the sliding surface 14*b* and the inner peripheral surface 22*a* face each other with a posture in which the end member 13 is inserted into the bearing 22, as will be described below.

The gear portion 15 is a gear provided between the contact wall 14*a* and the sliding surface 14*b* of the outer peripheral surface of the tubular body 14 and transmits a rotating force to the developing roller. According to the illustrated embodiment, the gear portion 15 is a spur gear. However, the type of the gear is not limited to a specific one. As long as the object can be achieved, a helical gear and the like may be used.

The connection portion 16 is a part provided to protrude from an outer side surface of the bottom of the tubular body 14. The connection portion 16 has the function of transmitting a rotating force from the rotating shaft 21 to the photoreceptor drum unit 10 by being connected to the rotating shaft 21 which is described below. Accordingly, the connection portion 16 has such a shape as to efficiently transmit the rotating force from the rotating shaft 21 to the end member 13. As long as such a function can be achieved, the shape of the connection portion 16 is not limited to a specific one. A shape can be exemplified as the shape of the connection portion 16, which is seen to be a rectangular when the connection portion 16 is viewed in the direction of the rotating shaft of the photoreceptor drum unit 10.

Preferably, such an end member 13 is formed of a resin, in the viewpoint of moldability. Consequently, even if the shape of the end member 13 is complex, the end member 13 can be prepared by injection molding or the like.

Next, the rotating shaft 21 and the bearing 22 illustrated in FIGS. 3, 4A, and 4B are described. The rotating shaft 21 is a member provided in the image forming device body 2. The bearing 22 is a member provided in the image forming device body 2 or the process cartridge 3.

The rotating shaft 21 is a cylindrical member arranged such that the rotational axis of the rotating shaft 21 is coaxial with the rotational axis of the photoreceptor drum unit 10. In addition, the rotating shaft 21 has a hole 21*a* formed in a surface arranged to face the end member 13 of the photoreceptor drum unit 10 so as to be able to accept the connection portion 16 of the end member 13.

The hole 21*a* is formed such that the connection portion 16 can be inserted into the hole 21*a*, and that the rotating force of the rotating shaft 21 can be transmitted to the photoreceptor drum unit 10 in a posture in which the connection portion 16 is inserted into the hole 21*a*. Accordingly, the rotating shaft 21 is arranged such that an end surface of the side thereof provided with the hole 21*a* faces an end surface of the end member 13 of the photoreceptor drum unit 20. On the other hand, an end surface of the side thereof, which is not provided with the hole 21*a*, is connected to a member serving as a driving source for the image forming device body 2.

Consequently, a rotating force can be given to the photoreceptor drum unit 10 from the image forming device body 2 via the rotating shaft 21.

In this embodiment, a mode has been described, in which the convex connection portion 16 is provided at the side of the end member 13 while the concave hole 21*a* is provided at the side of the rotating shaft 21, so that both the connection portion 16 and the concave hole 21*a* are connected to each other. However, a mode may be configured such that the concave and convex members are reversed in position. In addition, both the connection portion 16 and the concave hole 21*a* may be connected to each other by another means so that a rotating force can be transmitted.

The bearing 22 is a member for stably performing the rotation of the photoreceptor drum unit 10 and for retaining the position of the photoreceptor drum to thereby maintain the appropriate positional relation between the photoreceptor drum with another roller such as the developing roller. As can be seen from FIGS. 3, 4A and 4B, the bearing 22 is shaped like a cylinder. An opening at one side of the bearing 22 is slightly narrowed. The bearing 22 is arranged in the image forming device body 2 or the process cartridge 3 by being inhibited from rotating. The axis of the cylinder is set to be coaxial with the axis of rotation of each of the rotating shaft 21 and the photoreceptor drum unit 10.

As described above, the bearing 22 is formed such that the inside diameter Db of the bearing 22 is larger than the outside diameter Da of the part provided with the sliding surface 14*b* of the tubular body 14, by 0.06 mm or more. If at least one of the sliding surface 14*b* and the inner peripheral surface 22*a* of the bearing 22 has an axial inclination (what is called a taper), the difference between the outside diameter Da of the part provided with the sliding surface 14*b* and the inside diameter Db of the bearing 22 is 0.06 mm or more at each part in which the sliding surface 14*b* and the inner peripheral surface 22*a* face each other with a posture in which the end member 13 is inserted into the bearing 22, as will be described below.

Preferably, the bearing 22 is formed of a resin, in view of moldability. Consequently, the bearing 22 can be prepared by injection molding or the like.

As is well illustrated in FIG. 4B, the above photoreceptor drum unit 10, the rotating shaft 21, and the bearing 22 are combined with one another as follows. That is, the part provided with the sliding surface 14*b* of the end member 13 of the photoreceptor drum unit 10 is inserted into the inside of the cylinder of the bearing 22. Accordingly, the sliding surface 14*b* is arranged to face the inner peripheral surface 22*a* of the bearing 22.

Figure 5:
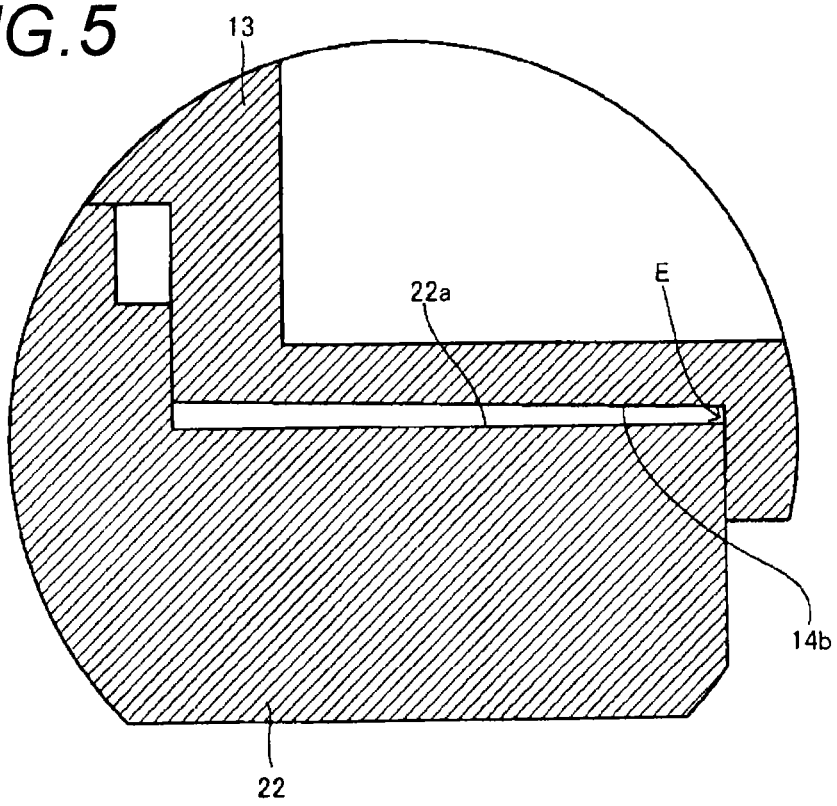
FIG. 5 is a diagram partly enlarging FIG. 4B.

The difference between the outside diameter Da of the part provided with the sliding surface 14*b* and the inside diameter Db of the bearing 22 is prescribed, as described above. Accordingly, when the photoreceptor drum unit 10 rotates, as will be described below, a predetermined gap can be formed between the sliding surface 14*b* and the inner peripheral surface 22*a*, as illustrated in FIG. 5 indicating a part designated by V in FIG. 4B. Alternatively, even if the gap is not always formed due to the vibrations or the like of the photoreceptor drum unit 10 during the rotation thereof, the chance of the contact between the sliding surface 14*b* and the inner peripheral surface 22*a* can be reduced. Consequently, when the photoreceptor drum unit 10 rotates, the melting or the fusion of the end member 13 and the bearing 22 can be suppressed. According to this embodiment, the sliding surface 14*b* is provided with an axial inclination. However, in this case, at a part (according to this embodiment, a part designated by E in FIG. 5) at which the difference between the outside diameter Da of the part provided with the sliding surface 14*b* and the inside diameter Db of the bearing 22 is minimum, the difference is 0.06 mm or more, preferably, 0.12 mm or more, and more preferably, 0.25 mm or more. The change of the contact between the sliding surface 14*b* and the inner peripheral surface 22*a* is more reduced by setting the difference between the diameters Db and Da to be larger. Thus, the advantages of suppressing the melting or the fusion of the bearing 22 can be enhanced.

On the other hand, the bearing 22 has the functions of retaining the position of the photoreceptor drum while the photoreceptor drum unit 10 rotates, maintaining the appropriate positional relation between the photoreceptor drum with another roller such as the developing roller, and thus performing the stable rotation of the photoreceptor drum. From such a viewpoint, it is preferable that the difference between the outside diameter Da of the part provided with the sliding surface 14*b* and the inner diameter Db of the bearing 22 is equal to or less than 0.5 mm.

Thus, in the case where a part of the end member 13 is arranged in the bearing 22, the connection portion 16 provided at the end member 13 passes through an opening of the bearing 22 and protrudes. Then, the protruded connection portion 16 is inserted into the hole 21*a* of the rotating shaft 21, so that the photoreceptor drum unit 10 and the rotating shaft 21 operate interlockingly with each other and is rotatably connected to each other.

Turning back to FIG. 2, the description of the process cartridge 3 is continued. Other components provided inside the casing 4 of the process cartridge 3, i.e., the charging roller 5, the developing roller 6, the regulating member 7, the transfer unit 8, and the cleaning blade 9 are as follows.

The charging roller 5 electrically charges the photoreceptor drum 11 by undergoing the application of voltage from the image forming device body. This is performed by causing the charging roller 5 to rotate following the photoreceptor drum 11 and to contact with the outer peripheral surface of the photoreceptor drum 11.

The developing roller 6 supplies a developer to the photoreceptor drum 11. Then, an electrostatic latent image formed on the photoreceptor drum 11 is developed by the developing roller 6. Incidentally, a stationary magnet is built into the developing roller 6.

The regulating member 7 adjusts an amount of a developer adhering to the outer peripheral surface of the above developing roller 6 and gives frictional electrification charges to the developer itself.

The transfer unit 8 is a roller for transferring images formed on the photoreceptor drum 11 to a recording medium such as paper.

The cleaning blade 9 contacts with the outer peripheral surface of the photoreceptor drum 11 and removes, with the front-edge thereof, the developer which remains after the transfer.

Each of the above rollers is rotatably housed inside the casing 4. That is, each of the rollers rotates, if necessary, inside the casing 4 to fulfill the functions thereof.

Here, each of the rollers and the blade provided in the process cartridge 3 has been described. However, members provided therein are not limited thereto. In addition, preferably, members, parts, developers and the like, which would usually be provided in the process cartridge, are provided therein.

Next, an operation of the image forming device 1 is described. When the image forming device 1 is operated, the process cartridge 3 having the above photoreceptor drum unit 10 is attached thereto by being inserted into the image forming device body 2 as indicated in FIG. 1. In addition, the process cartridge is connected to the rotating shaft 21 and the bearing 22. Then, the rotating shaft 21 is rotated, if necessary. Consequently, the photoreceptor drum unit 10 rotates and can be electrified by the charging roller 5.

In a state in which the photoreceptor drum unit 10 rotates in this manner, laser light corresponding to image information is irradiated onto the photoreceptor drum 11 using various types of optical members. Thus, an electrostatic latent image based on the image information is developed by the developing roller 6.

On the other hand, the recording medium such as paper is set in the image forming device body 2. The recording medium is conveyed by a delivery roller, a conveyance roller, and the like provided in the image forming device body 2 to a transfer position. The recording medium moves along line B shown in FIG. 2. The transfer unit 8 is arranged at the transfer position. As the recording medium passes through the transfer unit 8, a voltage is applied to the transfer unit 8, so that an image is transferred from the photoreceptor drum 11 to the recording medium. Thereafter, the image is fixed to the recording medium by applying heat and pressure to the recording medium. Then, the recording medium on which the image is formed is discharged from the image forming device body by a discharging roll and the like.

In such an operation, when the photoreceptor drum unit 10 rotates, the tubular body 14 rotates inside the bearing 22. According to the present invention, the above difference in diameter between the part provided with the sliding surface 14*b* and the bearing 22 is present. Thus, the contact between the sliding surface 14*b* and the inner peripheral surface 22*a* can be prevented or reduced. Consequently, the friction therebetween can be prevented or reduced.

That is, it has heretofore been considered as the cause of occurrence of melting that because the gap between the sliding surface and the inner peripheral surface is insufficient, the friction is large, and therefore, heat is easily generated. It has been also considered that because abrasion powder generated by the friction has few escapes, the abrasion powder is accumulated in the gap and melted to thereby easily cause fusion. As compared with this, with the configuration according to the present invention, the occurrence of the melting and fusion can be prevented or suppressed without using a lubricant-agent.

Especially, in recent years, the rotational speed of the photoreceptor drum unit 10 has been increased due to the speed-up of printing. Advantages of the present invention are prominently manifested.

Second Embodiment

A second embodiment has a feature in the arithmetic average roughness Ra of the sliding surface of the end member mounted at an end portion of the photoreceptor drum, which slide against the bearing.

Difference of the second embodiment from the first embodiment is the arithmetic average roughness Ra of the sliding surface of the end member mounted at an end portion of the photoreceptor drum, which slide against the bearing. The components of the first embodiment, which are illustrated in FIGS. 1 to 5, are common to the first and second embodiments. Thus, the description of the common components is omitted or simplified.

Figure 6A:
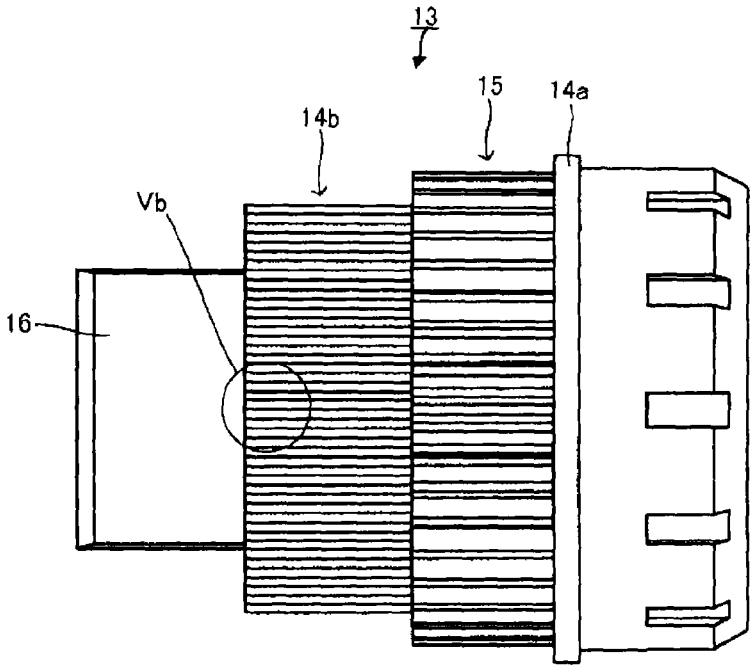
FIG. 6A is a diagram illustrating an external-appearance of an end member.
Figure 6B:
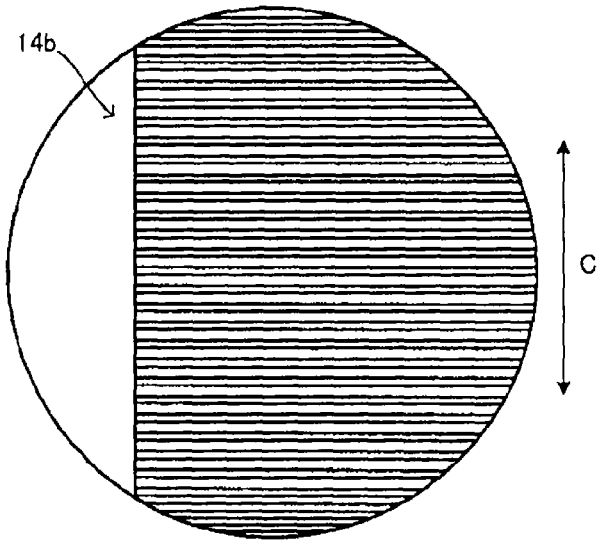
FIG. 6B is an enlarged view of a Vb-portion illustrated in FIG. 6A.

The sliding surface 14*b* is a rough surface whose surface roughness in terms of the arithmetic average roughness (Ra) is 0.5 μm or more. FIG. 6A shows a diagram illustrating the end member 13, which is taken from above as illustrated in FIG. 3. FIG. 6B is an enlarged view illustrating a part designated with Vb shown in FIG. 6A, for describing the surface condition of the sliding surface 14*b*. As is understood from FIGS. 6A and 6B, according to this embodiment, concave portions and convex portions extend in a direction along the axis of rotation of the end member 13. In addition, the sliding surface 14*b* is set to have a roughness such that the concave portion and the convex portion are parallel-arranged in the circumferential direction of the sliding surface 14*b*. Accordingly, the surface roughness Ra in the direction designated with C (i.e., in the circumferential direction of the sliding surface 14*b*) in FIG. 6B is usually 0.5 μm or more, preferably, 1.5 μm or more. On the other hand, preferably, the surface roughness Ra is 500 or less. The reason is that if the surface roughness Ra is larger than 500 μm, the roughness causes backlash when the end member slides. Incidentally, "Ra" means an arithmetic average roughness described in JIS B 0601-2001 (this is similarly applicable in the following descriptions).

Setting the sliding surface 14*b* as a surface having such a roughness can reduce the area of a region in which the sliding surface 14*b* substantially contacts with the inner peripheral surface 22*a* of the bearing 22, and also reduce the friction between the sliding surface 14*b* and the inner peripheral surface 22*a* of the bearing 22. Consequently, the melting and the fusion of the end member 13 and the bearing 22 can be suppressed without using a lubricant-agent. In addition, it is considered that the discharge of fine chips scraped from the sliding surface by friction can be facilitated and that the chips can be prevented from acting as an abrasive-agent which is a cause of increase of a coefficient of dynamic friction.

In addition, preferably, the kurtosis Ku of the sliding surface 14*b* is equal to or less than 2.8. The "kurtosis Ku" is a measure of the sharpness of a curved-surface in surface shape. The kurtosis Ku can characterize the breadth of a surface height distribution. The kurtosis can be obtained by calculating the fourth-order moment of a surface shape curved-surface. The kurtosis is sometimes referred to as a "roughness curve kurtosis". Setting the kurtosis Ku of the sliding surface 14*b* at 2.8 or less can reduce local friction. Consequently, even when no lubricant-agent is used, the melting and fusion of the end member 13 and the bearing 22 of the photoreceptor drum unit can be suppressed. On the other hand, preferably, the kurtosis Ku is equal to or more than 1.

In addition, preferably, the tubular body is formed so that the diameter (i.e., the outside diameter of the tubular body 14 at a part on which the sliding surface 14*b* is formed) Da of the sliding surface 14*b* illustrated in FIG. 4A is smaller than the diameter (i.e., the inside diameter of the bearing 22) Db, by 0.06 mm or more, of the inner peripheral surface 22*a* of a part of the bearing 22 to be described below, in which the sliding surface 14*b* is inserted. If at least one of the sliding surface 14*b* and the inner peripheral surface 22*a* of the bearing 22 has an axial inclination (what is called a taper), preferably, the difference between the diameter of the sliding surface 14*b* and the diameter of the inner peripheral surface 22*a* in each part in which the sliding surface 14*b* and the inner peripheral surface 22*a* face each other in a posture in which the end member 13 is inserted into the bearing 22, as will be described below, is equal to or more than 0.06 mm.

Preferably, such an end member 13 is formed of a resin, from the viewpoint of moldability. Consequently, even in the case where the shape of the end member 13 is complex, the end member 13 can be prepared by injection molding. The above rough surface provided on the sliding surface 14*b* can be obtained by roughening a part of an injection mold, to which the sliding surface is transferred, through cutting-work using a lathe, a milling-machine, or the like or through working which uses grinding, shotblasting or the like. At the formation of a rough surface, in the case where a rough surface is formed such that concave portions and convex portions extend in the circumferential direction of the sliding surface 14*b* and are parallel-arranged in a direction along the axis of rotation of the end member, as will be described below, undercut-processing such as forced-extraction or a slide core can be used. Alternatively, it is possible to form a rough surface spirally and to then extract each insert block by turning. In addition, in the case of performing crimp processing in a injection mold, etching using an organic solvent can be employed. In addition, machining such as shotblasting, cutting, and grinding, or chemical processing such as etching may be performed directly on an injection-molded article.

Figure 7A:
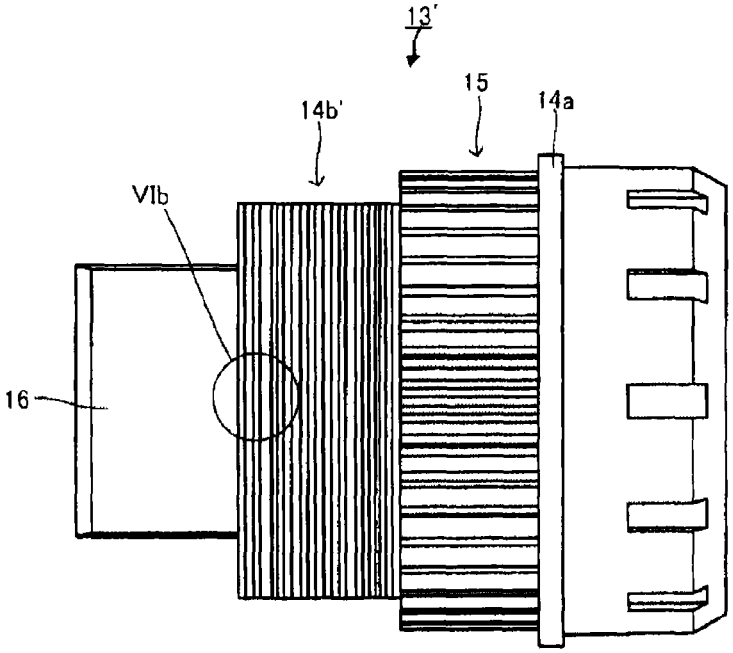
FIG. 7A is a diagram illustrating an external-appearance of an end member of another example.
Figure 7B:
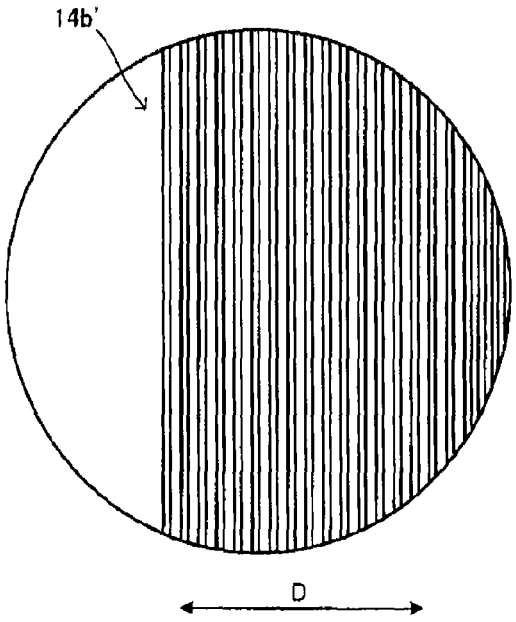
FIG. 7B is an enlarged view of a VIb-portion illustrated in FIG. 7A.

According to this embodiment, as described above, the sliding surface 14*b* is formed as a surface having a roughness so that concave portions and convex portions extend in a direction along the axis of rotation of the end member 13, and that the concave portions and the convex portions are parallel-arranged in the circumferential direction of the sliding surface 14*b*. However, according to the present invention, the direction in which the concave portions and the convex portions are arranged is not limited thereto. It is sufficient that the arithmetic average roughness Ra is equal to or higher than 0.5 μm in one direction on the sliding surface. FIG. 7 illustrates another example of an end member 13'. FIG. 7A corresponds to FIG. 6A. FIG. 7B corresponds to FIG. 6B, and is an enlarged view of a part VIb. The end member 13' differs only in the surface properties of the sliding surface 14*b*∝ from the end member 13. Other parts are common to the end members 13 and 13'. Thus, each of such parts of one of the end members is designated with the same reference numeral as that designating the corresponding part of the other end member. The description of each of the common parts is omitted.

As is seen from FIGS. 7A and 7B, the sliding surface 14*b*∝ of the end member 13' includes a rough surface formed so that concave portions and convex portions extend in a direction along the circumferential direction of the end member 13', and that the concave portions and the convex portions are parallel-arranged in a direction along the axis of rotation of the end member 13'. Accordingly, the surface roughness Ra in a direction designated with D shown in FIG. 7B (i.e., the direction of axis of rotation of the end member 13') is equal to or higher than 0.5 μm.

Thus, a direction in which the surface roughness of the sliding surface of the end member meets the following condition: Ra≥0.5 μm is not limited to a specific one. It is sufficient that the surface roughness of the sliding surface of the end member meets the above condition in one direction.

Preferably, the bearing 22 is formed such that the inside diameter Db is larger than the outside diameter Da of the part provided with the sliding surface 14*b* of the tubular body 14, by 0.06 mm or more. If at least one of the sliding surface 14*b* and the inner peripheral surface 22*a* of the bearing 22 has an axial inclination (what is called a taper), the difference between the outside diameter Da provided with the sliding surface 14*b* and the inside diameter Db of the bearing 22 in each part in which the sliding surface 14*b* and the inner peripheral surface 22*a* face each other in a posture in which the end member 13 is inserted into the bearing 22, as will be described below, is equal to or larger than 0.06 mm.

At that time, if the outside diameter Da provided with the sliding surface 14*b* and the inside diameter Db of the bearing 22 is regulated, as above described, a predetermined gap can be formed between the sliding surface 14*b* and the inner peripheral surface 22*a*, when the photoreceptor drum unit 10 rotates, as will be described, and as illustrated in FIG. 5 enlargedly illustrating the part designated with V in FIG. 4B. Alternatively, if the gap is not always formed due to the vibrations or the like of the photoreceptor drum unit 10 during the rotation thereof, the chance of the contact between the sliding surface 14*b* and the inner peripheral surface 22*a* can be reduced. Consequently, when the photoreceptor drum unit 10 rotates, the melting or the fusion of the end member 13 and the bearing 22 can be more suppressed. According to this embodiment, the sliding surface 14*b* is provided with an axial inclination. However, in this case, at a part (according to this embodiment, a part designated by E in FIG. 5) at which the difference between the outside diameter Da of the part provided with the sliding surface 14*b* and the inside diameter Db of the bearing 22 is minimum, the difference is 0.06 mm or more, preferably, 0.12 mm or more, and more preferably, 0.25 mm or more.

On the other hand, the bearing 22 has the functions of retaining the position of the photoreceptor drum while the photoreceptor drum unit 10 rotates, maintaining the appropriate positional relation between the photoreceptor drum with another roller such as the developing roller, and thus performing the stable rotation of the photoreceptor drum. From such a viewpoint, it is preferable that the difference between the outside diameter Da of the part provided with the sliding surface 14*b* and the inner diameter Db of the bearing 22 is equal to or less than 0.5 mm.

In an operation of the image forming device, when the photoreceptor drum unit 10 rotates, the end member 13 rotates inside the bearing 22. According to the second embodiment, the surface properties of the sliding surface 14*b* are regulated such that Ra≥0.5 μm. Thus, the area of contact between the sliding surface 14*b* and the inner peripheral surface 22*a* can be reduced. The friction between them can be reduced.

That is, heretofore, it has been considered as a cause of occurrence of melting that because the area of contact between the sliding surface and the inner peripheral surface is large, the friction between them is large, and heat is easily generated. On the other hand, the present invention can suppress the melting with the above configuration without using a lubricant-agent.

Particularly, with recent years' increase of printing speed, the rotational speed of the photoreceptor drum 10 has risen. Thus, the advantages of the present invention are prominently manifested.

If the kurtosis Ku of the sliding surface 14*b* is set to be equal to or less than 2.8, the sharpness of the unevenness is suppressed. Thus, the friction between the sliding surface 14*b* and the inner peripheral surface 22*a* can be suppressed.

If the above difference in diameter is provided between the part provided with the sliding surface 14*b* and the bearing 22, the contact between the sliding surface 14*b* and the inner peripheral surface 22*a* can be prevented or reduced. Consequently, the friction between them can be more prevented or reduced.

In the foregoing description, the embodiments have been described, in each of which the sliding surface 14*b* of the above predetermined configuration is formed at the side of the end member 13. However, from the viewpoint of obtaining advantages of the present invention, the present invention is not limited to such configurations of the embodiments. A sliding surface similar to the above sliding surface may be formed at the side of the bearing.

EXAMPLES

Hereinafter, the present invention is more described with reference to examples. However, the present invention is not limited to the examples.

Example 1

In the case of Example 1, specimens were prepared, which were changed in the relationship between the outside diameter Da of a part provided with a sliding surface and the inside diameter Db of the hole of the bearing. The melting and fusion of the sliding surface and the bearing were studied. Hereinafter, Example 1 is described in detail.

<Preparation of End Members Having Different Sliding Surface Diameters>

Any of the end members and the bearing employed polyacetal. The diameters Da of the sliding surfaces of the end members were adjusted by changing, when the injection molding of the end members was performed, pressure maintenance conditions after the injection of a resin. More specifically, a holding pressure was set to be larger, in comparison with the holding pressure in the case of Comparison Examples 1 and 2 to be described below. Thus, the end members respectively having the diameters Da of the sliding surfaced in the case of Examples 1-1 to 1-5 were prepared.

<Method of Measuring Diameter of Sliding Surface>

The diameter Da of the sliding surface was measured using a laser scan micrometer (RA-801 manufactured by Mitutoyo Corporation).

<Evaluation Method>

Where the relative sliding speed between the sliding surface and the inner peripheral surface was set at 9.3 m/minute, and the end member was attached to the photoreceptor drum, 5,000 sheets of images were printed at the above sliding speed by the image forming device. Then, the end member and the bearing were taken out therefrom, and the degrees of melting and wear of the sliding surface and the bearing were observed.

<Criteria for Evaluation of Results>

The sliding surface and the inner peripheral surface of the bearing were observed. Then, results were evaluated according to the following criteria.

x: A trace of the melting of the sliding surface due to temperature rise caused by friction was found. Or a trace of the serious abrasion of the sliding surface or the inner peripheral surface of the bearing by friction was found.

○: A trace of the slight abrasion of the sliding surface or the inner peripheral surface of the bearing by friction was found. However, no trace of the melting was found.

◎: No trace of the slight abrasion of the sliding surface or the inner peripheral surface of the bearing was found. No trace of the melting due to temperature rise was found.

<Results>

Table 1 shows the outside diameter Da of a part provided with the sliding surface, the inside diameter Db of the bearing, and the difference (Db−Da), and results of evaluation.

TABLE 1

| | Diameter of Sliding Surface (mm) | Inside Diameter of Bearing (mm) | (Db-Da) (mm) | Results |
|---|---|---|---|---|
| Comparative Example 1 | 16.57 | 16.605 | 0.035 | X |
| Comparative Example 2 | 16.567 | 16.619 | 0.052 | X |
| Example 1-1 | 16.552 | 16.615 | 0.063 | ○ |
| Example 1-2 | 16.554 | 16.651 | 0.097 | ○ |
| Example 1-3 | 16.552 | 16.67 | 0.117 | ○ |
| Example 1-4 | 16.39 | 16.643 | 0.253 | ◎ |
| Example 1-5 | 16.392 | 16.663 | 0.272 | ◎ |

In the cases of Comparative Examples 1 and 2, the difference (Db−Da) between the outside diameter of the part provided with the sliding surface of the end member and the inside diameter of the bearing was smaller than 0.06 mm. Both the results of evaluation in the cases of Comparative Examples 1 and 2 were x.

On the other hand, in the case of Examples 1-1 to 1-3, the difference (Db−Da) was equal to or larger than 0.06 mm. Although a trace of abrasion by friction was found on the sliding surface, no traces of melting were found. The evaluation was ○. In addition, in the case of Examples 1-4 and 1-5, the difference (Db−Da) was equal to or larger than 0.25 mm. The surfaces whose evaluation was indicated by a ◎ could be obtained.

Example 2

In Example 2, end members respectively having sliding surfaces, the surface roughness of each of which was changed, was prepared. Then, the melting and the fusion of the sliding surface and the bearing were studied. Hereinafter, Example 2 is described in detail.

<Preparation of End Members Respectively Having Sliding Surfaces Differing in Roughness>

In Table 2 to be described below, end members of Examples other than Reference Example 2 employed the general grade of polyacetal resin (i.e., F20-03 made by Mitsubishi Engineering Plastics, Co., Ltd.). The bearings employed polystyrene. The end members of Reference Example 2 employed resin obtained by making a polyacetal resin contain 20% by weight of fluorine resin having high slideability (i.e., FL-2020 made by Mitsubishi Engineering Plastics Co., Ltd.).

In the case of Reference Examples 1 and 2, end members were prepared by injection molding using a conventional mold. Then, the prepared end members respectively including sliding surfaces were used without being changed.

On the other hand, in the case of Examples 2-1 to 2-3 and Example 2-6, end members were molded by injection molding using a conventional mold. The faces of the sliding surfaces of the molded end members were machined using a milling-machine. In addition, the surface roughness in the circumferential direction of each of the sliding surfaces was adjusted by changing the cutting tool, and the cutting conditions (a feed-rate, a rotational speed, the application angle of a bite).

In addition, in the case of Examples 2-4 and 2-5, end members were molded by injection molding using a conventional mold. The sliding surfaces of the end members were machined using a numerical control (NC) milling-machine. The surface roughness in an axial direction was adjusted by changing programs to thereby change the size of a working tool and an engraving depth.

<Method of Measuring Ra and Kurtosis Ku of Sliding Surface>

In the case of rough surfaces (Examples 2-1 to 2-3, and 2-6) formed to have concave portions and convex portions parallel-arranged in an axial direction so that the concave portions and the convex portions extend in the circumferential direction of the sliding surface, a probe contact measurement in the case of a probe diameter of 5 μm was conducted using a surface roughness measuring machine (TEST-SV-548 manufactured by Mitutoyo Corporation). On the other hand, in the case of rough surfaces (Examples 2-4 and 2-5) formed to have concave portions and convex portions parallel-arranged in the circumferential direction of the sliding surface so that the concave portions and the convex portions extend in the axial direction of the end member, a probe contact measurement can be performed using a surface roughness measuring machine similar to the above surface roughness measuring machine. However, in the case of Example 2, when the measuring machine was used, data would exceed the measurement range of the measuring machine. Thus, a difference in level was measured in a non-contact manner using an image measuring machine (TESA-VISIO 300 manufacture by TESA Corporation).

<Method of Evaluation>

An evaluation method is as follows. In the case of each Example, one type of a printing pattern was repeatedly printed. At every 4,000-page printing, a break of 1 hour is taken. The printing of 12,000 pages was performed. Upon completion of this experiment, the sliding surface of the end member was visually evaluated. At an intermediate stage (i.e., when 4,000 pages were printed) of a test, the evaluation was conducted. In addition, the evaluation of the image quality of a finally output printed matter was performed. Incidentally, in the case of reference example 1, a lubricant-agent was used between the sliding surface and the inner peripheral surface. However, in the case of other examples, a lubricant-agent was not used. The sliding speed at that time was 13 m/minute.

<Criteria for Evaluation of Results>

Criteria for visual evaluation were as follows.

◎: the sliding surface was not melted. The sliding surface or the inner peripheral surface was not abraded by friction.

○: The sliding surface was not melted. A trace of the abrasion of the sliding surface or the inner peripheral surface of the bearing by friction was found.

x: The sliding surface was melted. In addition, a trace of the abrasion of the entire sliding surface or the entire inner peripheral surface of the bearing by friction was found.

On the other hand, the evaluation of the image quality of the finally output printed matter was as follows.

◎: No image defects were found.

○: An image defect was found in a region the area of which was less than 5% of the printed area.

x: An image defect was found in a region the area of which was equal to or more than 5% of the printed area.

<Results>

Table 2 shows the materials of the end members, the presence/absence of a lubricant-agent, (Db−Da), Ra, Kurtosis Ku, "rough surface direction", and results of evaluation. The (Db−Da) shown in Table 1 is the difference between the outside diameter (Da) of the part provided with the sliding surface of the bed member and the inside diameter (Db) of the bearing. The "rough surface direction" is defined such that if the concave portions and the convex portions extend in the circumferential direction of the sliding surface and the rough surface has the concave portions and the convex portions parallel-arranged in an axial direction, the "rough surface direction" is a "circumferential direction", and that if the concave portions and the convex portions extend in the axial direction of the sliding surface and the rough surface has the concave portions and the convex portions parallel-arranged in the circumferential direction, the "rough surface direction" is an "axial direction".

TABLE 2

| | Material of End Member | Lubricant Agent | Db-Da (mm) | Ra (μm) | Kurtosis Ku | Rough Surface Direction | Evaluation Results: Interim Sliding Surface 4000 pages | Final Sliding Surface 12000 pages | Final Image Quality 12000 pages |
|---|---|---|---|---|---|---|---|---|---|
| Reference Example 1 | POM (Poly-Carbonate Membrane) | Present | 0.289 | 0.38 | 2.581 | None | ◎ | ◎ | ◎ |
| Reference Example 2 | POM + Fluorine resin | Absent | 0.229 | 0.38 | 2.581 | None | ○ | ○ | ◎ |
| Example 2-1 | POM | Absent | 0.298 | 0.55 | 2.948 | Circumferential | ◎ | ○ | ◎ |
| Example 2-2 | POM | Absent | 0.303 | 1.88 | 2.541 | Circumferential | ◎ | ◎ | ◎ |
| Example 2-3 | POM | Absent | 0.308 | 5.93 | 1.555 | Circumferential | ◎ | ◎ | ◎ |
| Example 2-4 | POM | Absent | 0.302 | 65 | — | Axial | ◎ | ◎ | ◎ |
| Example 2-5 | POM | Absent | 0.303 | 202.5 | — | Axial | ◎ | ◎ | ◎ |
| Example 2-6 | POM | Absent | 0.065 | 1.77 | 1.787 | Circumferential | ○ | ○ | ◎ |

As is understood from comparison between Reference Examples 1 and 2 and Examples 2-1 to 2-6, even if no lubricant-agent is used, advantages similar to those in the case of using a lubricant-agent could be obtained by setting the sliding surface such that Ra≥0.5 μm. It was found that the rough surface direction for obtaining such results might be either of the circumferential direction and the axial direction. Accordingly, it is considered that even in the case of a rough surface having a pattern corresponding to another direction, i.e., an oblique direction, a pattern in a non-continuous (i.e., point-like or the like), or a pattern obtained by crimp-processing, or a rough surface formed by embossing, similar advantages can be obtained.

As is understood from comparison between Reference Example 2 and Examples 2-1 to 2-6, results in the case of Examples 2-1 to 2-5 are better than a result in the case of Reference Example 2, though a resin of the end member corresponding to Reference-example 2 excels in slideability very much. The results in the case of Examples 2-1 to 2-5 are equivalent to the result in the case of Example 2-6. Accordingly, it is understood that the surface roughness Ra is more important than the slideability of the resin itself.

As is understood from Example 2-6, even if (Db—Da) is small, favorable results can be obtained by appropriately adjusting Ra.

The present invention is not limited to the above embodiments. Appropriate modifications, improvements, and the like can be made. In addition, the material, the shape, the dimension, the numerical—value, form, the number, and the location of each component of the above embodiments are optional and not limited, as long as the present invention is achieved.

Although the present invention has been described in detail with reference to the specific embodiments, it is apparent to those skilled in the art that the present invention can be changed or modified in various manners without departing from the spirit and scope of the present invention.

According to the present invention, melting and fusion of the end member and the bearing of the photoreceptor drum unit can be suppressed without using a lubricant-agent.

What is claimed is:

1. A process cartridge, comprising:

a cylindrical photoreceptor drum;

a member having a tubular body which is mounted at an end portion of the photoreceptor drum and which has an outer circumferential surface serving as a sliding surface; and a bearing configured to have a hole which defines an inner peripheral surface that faces the sliding surface, the bearing supporting the tubular body of the member by inserting the tubular body into the hole, wherein a difference between an outside diameter of a part provided with the sliding surface of the member and a diameter of the hole of the bearing is equal to or more than 0.06 mm and equal to or less than 0.5 mm.

2. The process cartridge according to claim 1, wherein the sliding surface of the member has an arithmetic average roughness (Ra) in one direction being equal to or more than 0.5 μm.

3. The process cartridge according to claim 2, wherein a kurtosis (Ku) of the sliding surface of the member is equal to or less than 2.8.

4. The process cartridge according to claim 1, wherein at least one of the sliding surface of the member and the inner peripheral surface of the bearing has an axial inclination.

5. A member having a tubular body which is mounted at an end portion of a photoreceptor drum, and which has an outer peripheral surface serving as a sliding surface, wherein the sliding surface has an arithmetic average roughness (Ra) in one direction being equal to or more than 0.5 μm.

6. The member according to claim 5, wherein a kurtosis (Ku) of the sliding surface is equal to or less than 2.8.

7. The member according to claim 5, wherein the sliding surface has an axial inclination.

8. A photoreceptor drum unit, comprising;

a cylindrical photoreceptor drum; and a member having a tubular body which is mounted at an end portion of the photoreceptor drum and which has an outer circumferential surface serving as a sliding surface, wherein the sliding surface of the member has an arithmetic average roughness (Ra) in one direction being equal to or more than 0.5 μm.

9. The photoreceptor drum unit according to claim 8, wherein a kurtosis (Ku) of the sliding surface of the member is equal to or less than 2.8.

10. The photoreceptor drum unit according to claim 8, wherein the sliding surface of the member has an axial inclination.

11. A process cartridge, comprising;

a cylindrical photoreceptor drum;

a member having a tubular body which is mounted at an end portion of the photoreceptor drum and which has an outer circumferential surface serving as a sliding surface; and a charging roller which is a cylindrical roller provided to be able to electrically charge the photoreceptor drum, and a developing roller which is a cylindrical roller that supplies a developer to the photoreceptor drum, wherein the sliding surface of the member has an arithmetic average roughness (Ra) in one direction being equal to or more than 0.5 μm.

12. The process cartridge according to claim 11, wherein a kurtosis (Ku) of the sliding surface of the member is equal to or less than 2.8.

13. The process cartridge according to claim 11, wherein the sliding surface of the member has an axial inclination.

* * * * *